US005678428A

United States Patent [19]

Pasquetti

[11] Patent Number: 5,678,428

[45] Date of Patent: Oct. 21, 1997

[54] ANNULAR PIECE OF JEWELRY SUCH AS A RING OR A BRACELET HAVING AN OUTER ROTARY CROWN

[75] Inventor: Ornella Pasquetti, Milan, Italy

[73] Assignee: Piaget International S.A., La Cote Aux Fees, Switzerland

[21] Appl. No.: 630,451

[22] Filed: Apr. 10, 1996

[30] Foreign Application Priority Data

Apr. 11, 1995 [EP] European Pat. Off. ..... 95830141

[51] Int. Cl.[6] ..... A44C 9/00

[52] U.S. Cl. ..... 63/15.2; 63/15.1

[58] Field of Search ..... 63/15, 15.1, 15.2, 63/15.3, 15.4, 15.7

[56] References Cited

U.S. PATENT DOCUMENTS 1,712,417 5/1929 Beaujard, Jr. ..... 63/15.3
5,161,392 11/1992 Wiriath et al. .
5,228,316 7/1993 Meyrowitz .

FOREIGN PATENT DOCUMENTS 0529168 3/1993 European Pat. Off. .
9415365 11/1994 Germany .
60-255264 12/1985 Japan .
94/22341 10/1994 WIPO .

*Primary Examiner*—Kien T. Nguyen
*Attorney, Agent, or Firm*—Oliff & Berridge

[57] ABSTRACT

An annular piece of jewelry such as a ring or a bracelet has an outer crown able to rotate between two annular lateral edges of an inner crown concentric with the outer crown. The inner crown includes the soldered assembly of two half-crowns having the same inside diameter, the same outer configuration, and substantially the same axial length, each of the half-crowns being formed of an annular element which has, at one end edge, a convex bearing able to form a lateral retaining bead for the outer crown and a cylindrical annular bearing, able to engage the outer crown, each of the annular elements having, at its opposite end edge, a tubular bearing with a thickness smaller than the thickness of the cylindrical annular bearing, the smaller-thickness tubular bearing extending from the inner surface and the outer surface respectively of the annular cylindrical bearings in such a way as to define an internal annular cavity able to receive a soldering material when the two annular elements are brought into abutment to form the inner crown.

4 Claims, 2 Drawing Sheets

Figure 1:
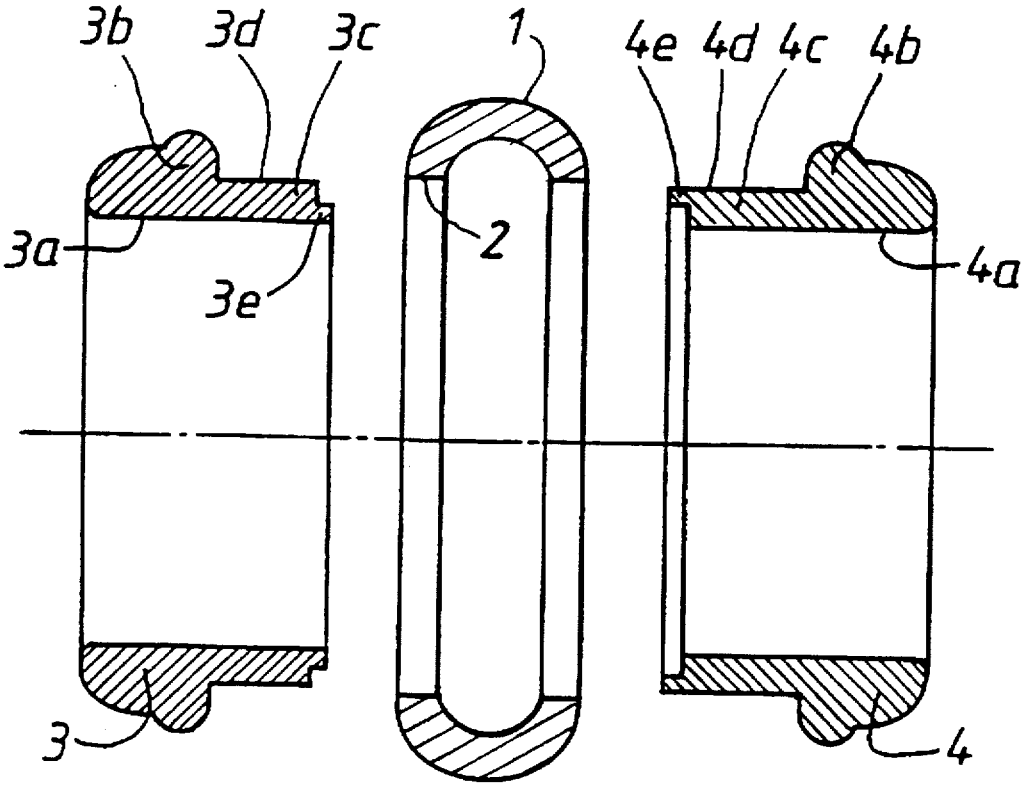

ANNULAR PIECE OF JEWELRY SUCH AS A RING OR A BRACELET HAVING AN OUTER ROTARY CROWN

The present invention relates to an annular piece of jewelry such as a ring or a bracelet having an outer rotary crown.

Such pieces of jewelry made of precious materials, particularly gold, whose outer crown can rotate between two annular lateral edges of an inner crown concentric with the outer crown, have been known for a very long time.

The inner crown has, between the two edges, a cylindrical bearing with a surface on which the outer crown is engaged, the inside diameter of the outer crown being slightly greater than the outside diameter of the cylindrical bearing of the inner crown to allow said outer crown to rotate.

Various configurations of such annular pieces of jewelry have already been proposed, as well as various methods for manufacturing them, particularly by expansion or by soldering.

Thus, EP-A-0,529,168 teaches an annular piece of jewelry wherein an inner crown is machined with a central bearing surface that has a larger diameter and two lateral bearing surfaces on which are soldered separate rings that constitute the lateral edges.

To make such an annular piece of jewelry, it is necessary, in order to form the inner crown, to machine three separate components, then to carry out two soldering operations to attach each of the lateral rings to the corresponding lateral bearing surfaces of the inner crown.

The present invention proposes to improve such a design by requiring, for manufacturing the inner crown, only two elements, which moreover can be obtained from identical blanks, which can be assembled in a single soldering operation.

The present invention is characterized by an inner crown that is made by soldering together two half-crowns that have the same inside diameter, the same outer configuration, and essentially the same axial length. Each of the half-crowns is formed from an annular element that has, at one end edge, a convex bearing surface able to form a lateral retaining bead for the outer crown and a cylindrical annular bearing able to engage the outer crown. Each of the annular elements has, at its opposite end edge, a tubular bearing with a thickness smaller than the thickness of the cylindrical annular bearing. The tubular bearings of reduced thickness extend from the inner surface and from the outer surface respectively of the annular cylindrical bearings in such a way as to define an internal annular cavity able to receive a soldering material when the two annular elements are brought into abutment to form the inner crown.

In the assembled state, the end tubular bearings of the annular elements nest into each other to provide continuous inner and outer surfaces. The outer surfaces constitute cylindrical bearing surfaces of an inner crown for rotation of an outer crown.

Figure 2:
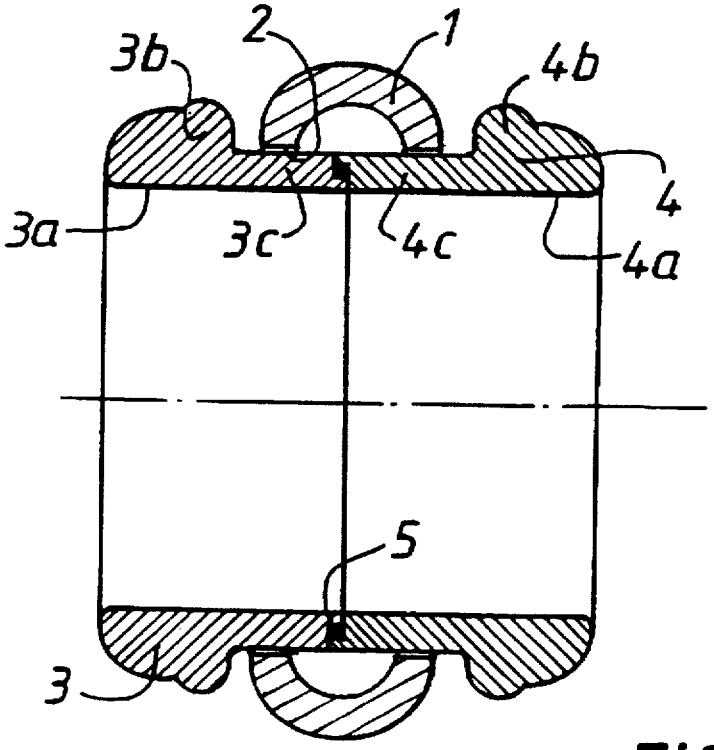
Figure 3:
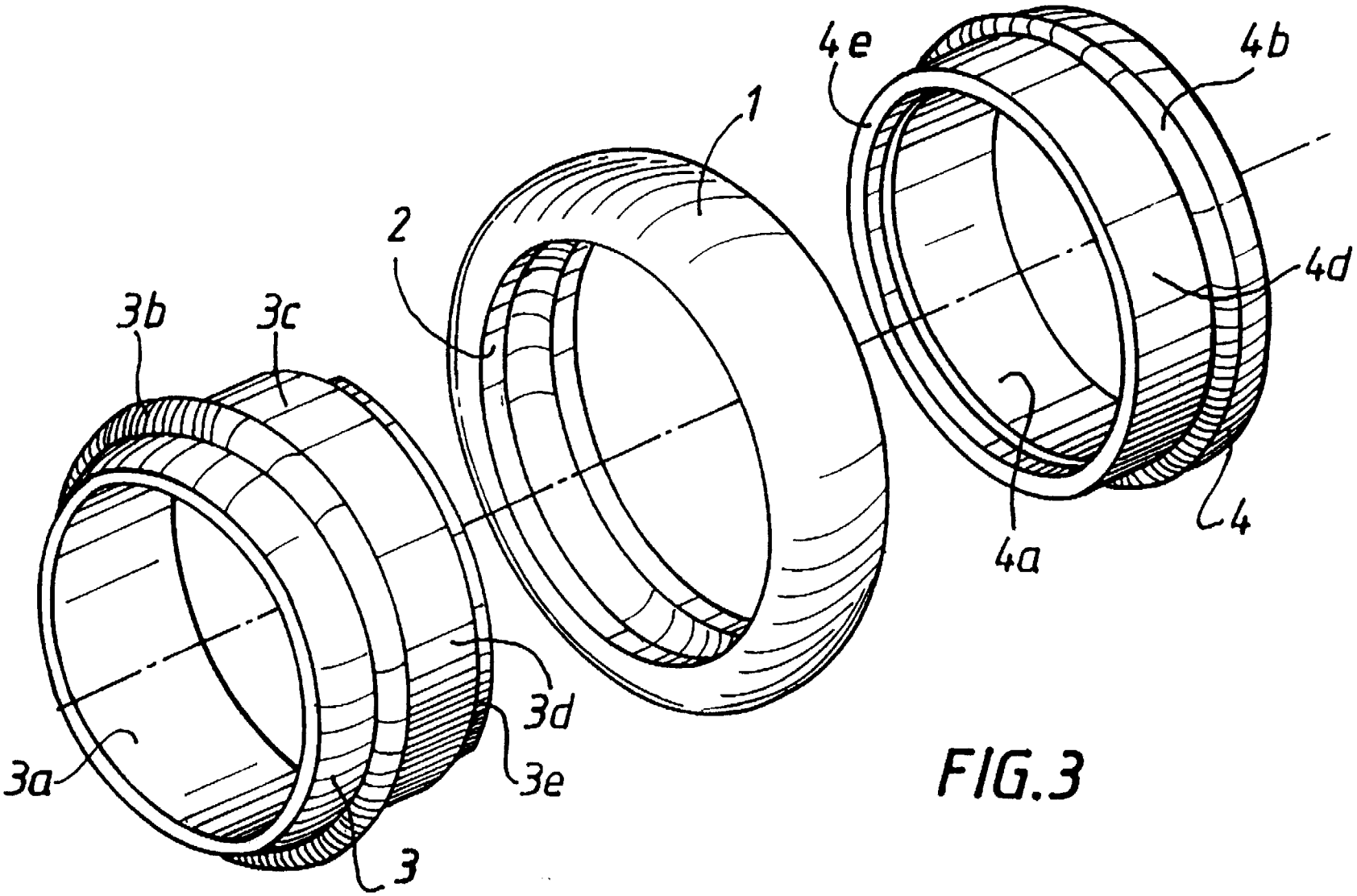

Other advantages and characteristics of the invention will emerge from reading the description hereinbelow of an embodiment that is not limiting, with reference to the attached drawing wherein:

FIG. 1 is a cross-sectional view of the components of a piece of annular jewelry according to the invention before assembly, FIG. 2 is a is a cross-sectional view of the same components after assembly, FIG. 3 is an exploded perspective view corresponding to the arrangement illustrated in FIG. 1.

The piece of annular jewelry according to the invention such as a ring has an outer crown 1 having a cylindrical inner surface 2, concave in the example illustrated but also possibly solid.

An inner crown is constituted by assembling two annular elements 3 and 4 each of which has an inner cylindrical surface 3*a* and 4*a* respectively, of the same diameter, and an outer convex bearing surface 3*b* or 4*b* preferably extending from end edges of corresponding elements 3 and 4 respectively.

Outer crown 1 and elements 3, 4 forming the outer crown are for example made of gold that has been previously melted to be of a desired grade.

The convex bearing surfaces are extended in the direction of an opposite edge of each of elements 3 and 4 by cylindrical annular bearings 3*c* and 4*c* respectively, which have the same thickness and whose outer surfaces 3*d* and 4*d* define a diameter that is slightly smaller than the diameter defined by inner surface 2 of outer crown 1.

Bearing 3*c* of annular element 3 has, at its free end, a tubular bearing 3*e* that has a smaller thickness than the thickness of bearing 3*c*.

Tubular bearing 3*e* extends from inner surface 3*a* of element 3, and projects forward with respect to the end edge of outer surface 3*d* of element 3.

Element 4, has an end tubular bearing 4*e* with a thickness smaller than that of bearing 4*c* extending from outer surface 4*d* of bearing 4*c*.

Projecting tubular bearing 4*e* constitutes the free end edge of bearing 4*c*.

Tubular bearings 3*e* and 4*e* have the same axial length.

Tubular bearings 3*e* and 4*e* preferably have the same thickness, with the sum of the thicknesses of these tubular bearings 3*e* and 4*e* being less than the thickness of bearings 3*d* and 4*d* such that, when annular elements 3 and 4 are brought into mutual abutment, as illustrated in FIG. 2, an annular cavity 5 forms between tubular bearings 3*e* and 4*e*. The cavity is fillable with a soldering material to ensure assembly of elements 3 and 4 inside crown 1.

A single soldered joint is thus formed substantially in the center of outer crown 1. Since the joint is formed in the thickness of the inner crown constituted by assembling elements 3 and 4, it is entirely invisible.

Elements 3 and 4 can be made separately by machining, or can alteratively be formed from identical blanks obtained from the same mold. The complementary ends of the elements can be machined to obtain the arrangement illustrated.

In the example illustrated, the width of outer crown 1 is less than the width of the cylindrical bearing provided between convex bearing surfaces 3*b* and 4*b* of assembled elements 3 and 4, allowing lateral movement of outer crown 1 in addition to rotational movement.

Although the invention has been described in connection with a particular embodiment, it is obvious that it is not limited thereto and a number of variants and modifications can be made therefrom without thereby departing from its framework or its spirit.

What is claimed is:

1. An annular piece of jewelry having an outer crown able to rotate between two annular lateral edges of an inner crown concentric with said outer crown, said inner crown comprising a soldered assembly of two half-crowns having the same inside diameter, the same outer configuration, and substantially the same axial length, each of said half-crowns being formed of an annular element which has, at one end edge, a convex bearing surface integral therewith and able to form a lateral retaining bead for said outer crown and a cylindrical annular bearing able to engage said outer crown, each of said annular elements having, at its opposite end edge, a tubular bearing with a thickness smaller than the thickness of said cylindrical annular bearing, said smaller-thickness tubular bearing extending from an inner surface and an outer surface respectively of the cylindrical annular bearings of said annular elements in such a way as to define an internal annular cavity between said smaller-thickness tubular bearings when the two annular elements are brought into mutual abutment to form said inner crown, said internal annular cavity receiving a soldering material.

2. The annular piece of jewelry according to claim 1, wherein said smaller-thickness tubular bearings have the same axial length.

3. The annular piece of jewelry according to claim 1, wherein said smaller-thickness tubular bearings have the same thickness.

4. The annular piece of jewelry according to claim 1, wherein said piece of jewelry is a ring or bracelet.

* * * * *